US007594505B2

(12) United States Patent
Gan

(10) Patent No.: US 7,594,505 B2
(45) Date of Patent: Sep. 29, 2009

(54) GAS GUN HAVING A PRESSURE DRIVING DEVICE

(76) Inventor: Yiauguo Gan, No. 388-1, Houjuang Road, Beitun Chu, Taichung, 40682 (TW)

( * ) Notice: Subject to any disclaimer, the term of this patent is extended or adjusted under 35 U.S.C. 154(b) by 0 days.

(21) Appl. No.: 12/031,940

(22) Filed: Feb. 15, 2008

(65) Prior Publication Data

US 2008/0127960 A1 Jun. 5, 2008

Related U.S. Application Data

(63) Continuation-in-part of application No. 11/335,401, filed on Jan. 19, 2006, now abandoned.

(51) Int. Cl.
*F41B 11/00* (2006.01)

(52) U.S. Cl. ..... 124/77; 124/73

(58) Field of Classification Search ..... 124/73–77
See application file for complete search history.

(56) References Cited

U.S. PATENT DOCUMENTS

| | | | | |
|---|---|---|---|---|
| 5,257,614 | A | 11/1993 | Sullivan | |
| 5,349,938 | A | 9/1994 | Farrell | |
| 5,778,868 | A | 7/1998 | Shepherd | |
| 5,908,024 | A | 6/1999 | Staev | |
| 6,371,099 | B1 | 4/2002 | Lee | |
| 6,925,997 | B2 | 9/2005 | Sheng | |
| 7,044,119 | B2 * | 5/2006 | Jones | 124/74 |
| 7,146,973 | B2 | 12/2006 | Seekman et al. | |
| 7,150,276 | B1 | 12/2006 | Rice | |
| 7,185,646 | B2 * | 3/2007 | Jones | 124/74 |
| 2004/0084040 | A1 | 5/2004 | Jones | |
| 2006/0011188 | A1 | 1/2006 | Jones | |
| 2006/0027221 | A1 | 2/2006 | Farrell | |
| 2006/0124118 | A1 | 6/2006 | Dobbins | |
| 2006/0162714 | A1 | 7/2006 | Lai | |
| 2006/0162715 | A1 * | 7/2006 | Jones | 124/74 |
| 2006/0207587 | A1 | 9/2006 | Jones et al. | |
| 2006/0225718 | A1 | 10/2006 | Kirwan | |
| 2007/0068502 | A1 | 3/2007 | Jones et al. | |

* cited by examiner

*Primary Examiner*—Troy Chambers
*Assistant Examiner*—Jonathan C Weber
(74) *Attorney, Agent, or Firm*—Banger Shia

(57) ABSTRACT

A gas gun having a pressure driving device comprises an upper housing having a loading device disposed therein, the loading device having a tubular member and a projectile member; a hand grip mounted on and extending from the lower side of the upper housing; wherein between the tubular member and the projectile member is mounted an air valve so as to be moved forward and rearward by pneumatic air to control a projectile channel of the projectile member and an internal passage of the tubular member to be opened and closed.

6 Claims, 5 Drawing Sheets

GAS GUN HAVING A PRESSURE DRIVING DEVICE

This application is a Continuation-in-Part of application Ser. No. 11/335,401 filed Jan. 19, 2006 now abandoned.

BACKGROUND OF THE INVENTION

1. Field of the Invention

The present invention relates to a gas gun, and more particularly to a gas gun having a pressure driving device that may decrease the consumption of the pneumatic air and increase the propel times of the paintballs in a certain amount of the pneumatic air supplied by a gas bottle.

2. Description of the Prior Arts

A conventional gas gun comprises a projectile feed tube for supplying paintballs into a barrel of a gun body one at a time, and the paintballs are preferably spherical in form and contain a marking fluid therein, a loading bolt is slidably disposed in the rear portion of the barrel for engaging with the one paintball supplied or fed into the barrel and for feeding or loading the paintball slightly forwardly toward a firing position.

For example, U.S. Pat. No. 6,371,099 to Lee discloses one of the typical gas guns comprising a loading bolt slidably disposed in a rear portion of a barrel of a gun body for engaging with the paintball and for feeding or loading the paintball forwardly toward a firing position to wait for being fired. Normally, a hammer and a complicated control device are further required to be provided and attached to the gun body for moving or operating or actuating the loading bolt to engage and to feed or load the paintballs.

However, such a conventional air gun will quickly consume the pneumatic air, and may not be easily manufactured and assembled, thus increasing manufacturing cost.

The present invention has arisen to mitigate and/or obviate the afore-described disadvantages.

SUMMARY OF THE INVENTION

The primary object of the present invention is to provide a gas gun having a pressure driving device including a third chamber formed in an upper housing for storing the pneumatic air, and as the third chamber is completely full of the pneumatic air, a control valve may stop inputting the pneumatic air, thus decreasing the consumption of the pneumatic air and increasing the propel times of the paintballs in a certain amount of the pneumatic air supplied by a gas bottle.

The secondary object of the present invention is to provide a gas gun having a pressure driving device including a loading device which may be moved between first and second positions based on the flowing direction of the pneumatic air so as to open or close a projectile member or a tubular member, thus shortening the propel time.

Another object of the present invention is to provide a gas gun having a pressure driving device that may simplify the structure of the gas gun for decreasing production cost and increasing portable mobility.

In accordance with one aspect of the present invention, there is provided a gas gun having a pressure driving device comprising a hollow upper housing including a feeding inlet provided on and passing through the top surface thereof, a front port and a rear port disposed on and communicating with the bottom thereof respectively, and a hand grip mounted on and extending from the lower side thereof and having a control valve arranged therein, the front and rear ports communicating with the control valve through a front hose and a rear hose individually, such that the control valve may control the pneumatic air to flow into the front port or the rear port, wherein the upper housing further includes an end cap fixed at the opening of the distal end thereof for being tightly covered, and a loading device is disposed therein so as to be pushed by the pneumatic air to move frontward and backward between first and second positions, such that when the loading device is located at the first position, the feeding inlet is closed, and when the loading device is located at the second position, the feeding inlet is opened, the loading device includes a projectile member and a tubular member, one end of the projectile member is provided to propel a paintball, and another end thereof is inserted into the tubular member, the projectile member includes a projectile channel axially mounted therein, and the tubular member includes an internal passage axially arranged therein and a plurality of bores formed therearound, one end of the tubular member is provided to receive the projectile member, and another end thereof is inserted into the end cap; between the loading device and the upper housing are provided with a first chamber and a second chamber, the first chamber is in communication with the rear port, and the second chamber is in communication with the front port, between the tubular member and the upper housing is formed a closed third chamber for communicating with the internal passage through the bores;

between the projectile channel and the internal passage is defined with an air valve, and the air valve is pushed by the pneumatic air to move frontward and backward between the first and second positions, as the air valve is located at the first position, it closes the projectile channel so that the pneumatic air flows among the first chamber, the internal passage and the third chamber, and the loading device is pushed to move from the first position to the second position; as the third chamber is completely full of the pneumatic air, the control valve may stop releasing the pneumatic air, at the moment the pneumatic air in the third chamber flows back to impact the air valve to move toward the second position, opening the projectile channel and closing the internal passage, such that the pneumatic air may flow through the projectile channel to propel the paintball outwardly; additionally, as the pneumatic air released from the control valve is inputted into the second chamber through the front hose, the loading device is pushed back to the first position.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
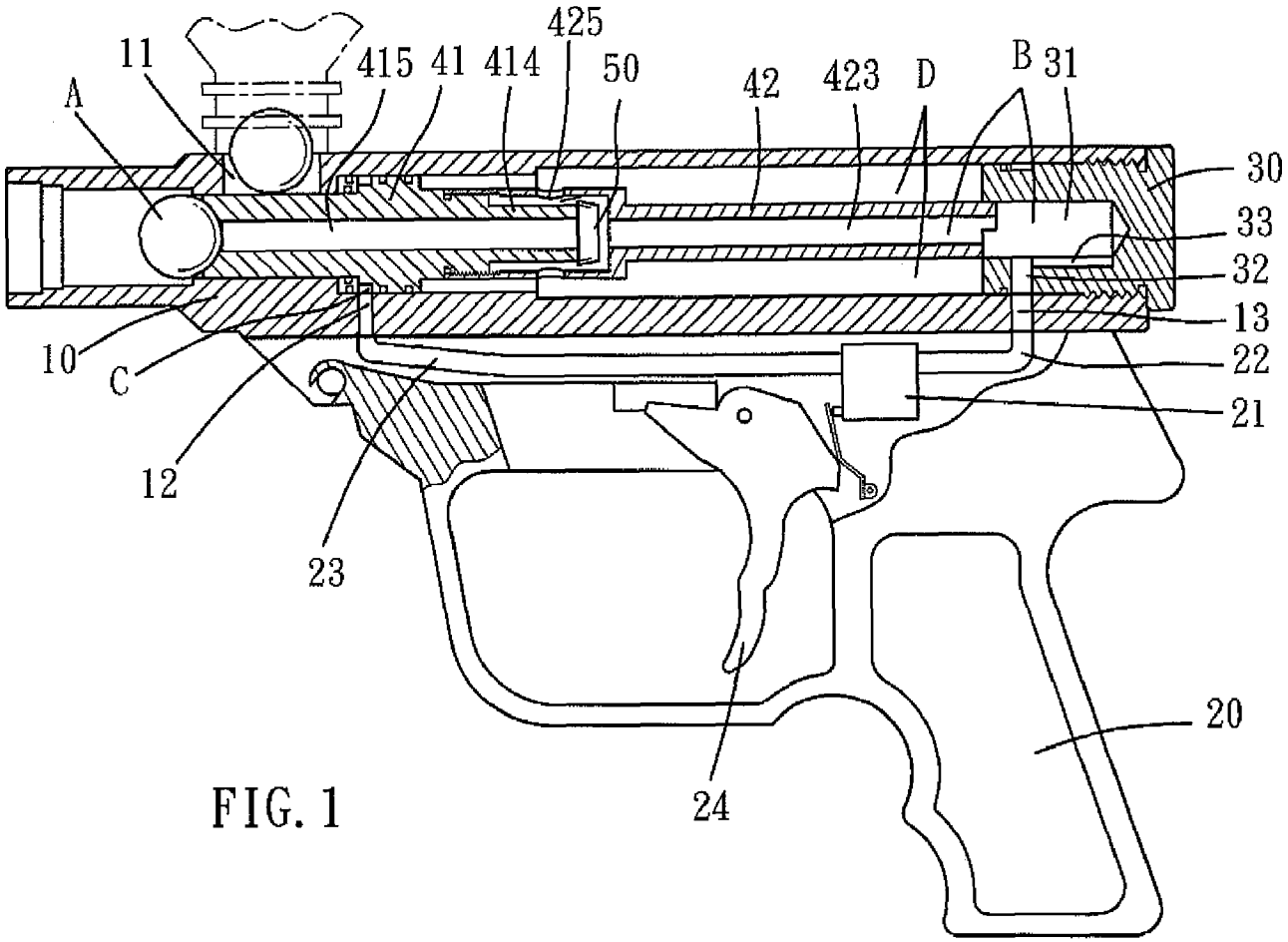
FIG. 1 is a cross sectional view illustrating the assembly of a gas gun having a pressure driving device according to the present invention.

Referring to FIG. 1, a gas gun having a pressure driving device in accordance with the present invention comprises a hollow upper housing 10 including a feeding inlet 11 provided on and passing through the top surface thereof to hold a feeding funnel, such that a plurality of paintballs A can be fed into the feeding inlet 11 through the feeding funnel in order, including a front port 12 and a rear port 13 disposed on and communicating with the bottom thereof respectively; a hand grip 20 mounted on and extending from the lower side of the upper housing 10. The hand grip 20 includes a control valve 21 arranged between the front and rear ports 12, 13, and communicating with the front port 12 through a front hose 23, and also communicating with the rear port 13 through a rear hose 22, such that the control valve 21 controls pneumatic air to flow into either the front port 12 or the rear port 13. The upper housing 10 further includes an end cap 30 fixed at an opening of a distal end thereof to tightly cover the opening of the distal end thereof. The end cap 30 includes a receiving cavity 31 secured therein in a radial direction to receive a second conduit portion 422, and includes an aperture 32 affixed therein in an axial direction to communicate the receiving cavity 31 and the rear port 13 with each other, between the aperture 32 and the bottom of the receiving cavity 31 is defined with a recess 33.

Figures 2, 2A:
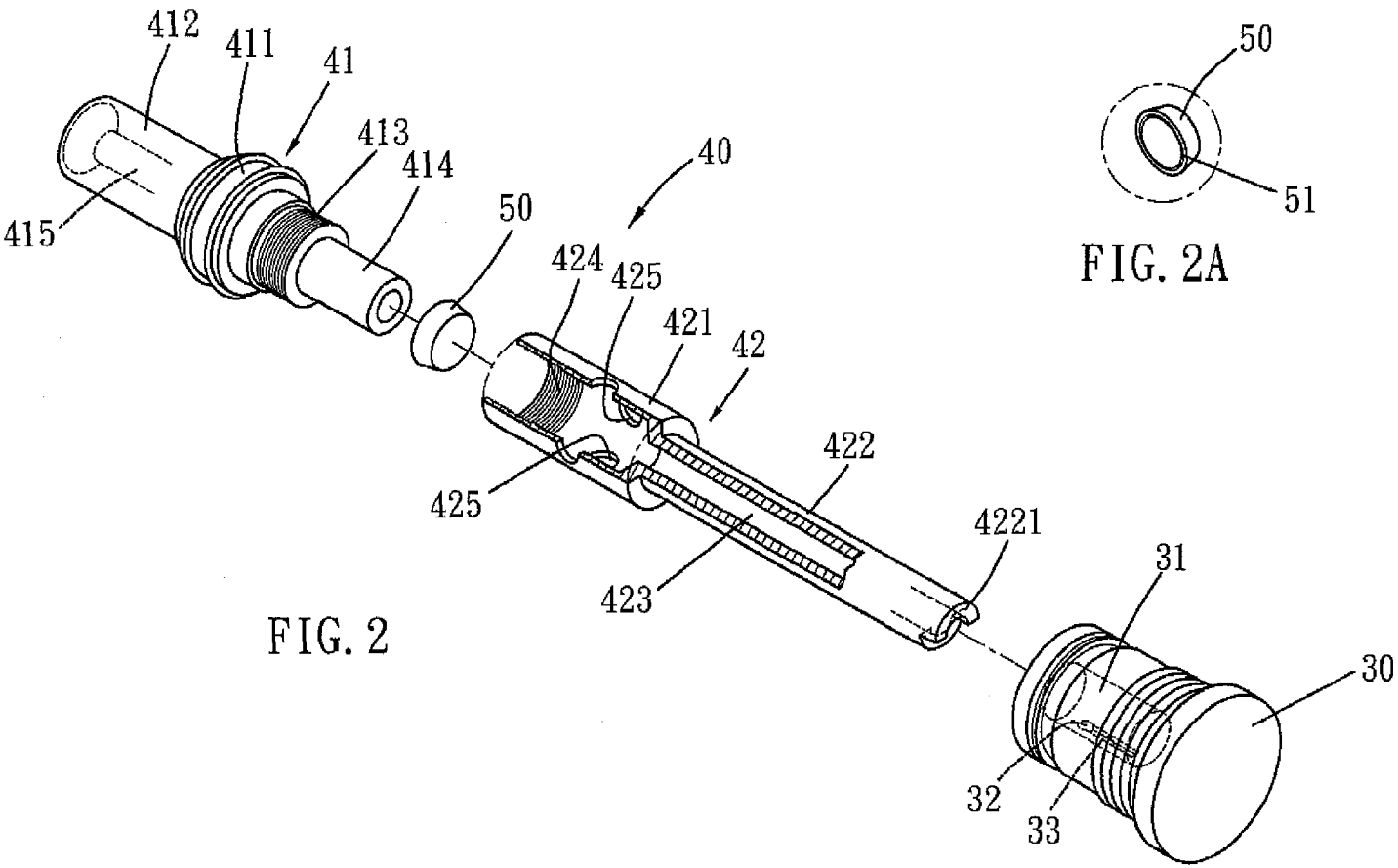
FIG. 2 is a perspective view illustrating the exploded components of an end cap and a loading device of the gas gun according to the present invention.
FIG. 2A is a perspective view illustrating the exploded components of an air valve of the gas gun according to the present invention.

The upper housing 10 includes a loading device 40 (as show in FIG. 2) disposed therein so as to be pushed by the pneumatic air to move frontward and backward between first and second loading device positions, such that when the loading device 40 is located at the first loading device position, the feeding inlet 11 is closed and then the paintball A is pushed toward the feeding position by an end portion of the loading device 40, and when the loading device 40 is located at the second loading device position, the feeding inlet 11 is open so that the paintball A can be further fed into the upper housing 10. As illustrated in FIG. 2, the loading device 40 is comprised of the projectile member 41 and a tubular member 42, the projectile member 41 includes a peripheral bulge 411 having a loading bolt 412 and an outer thread 413 formed on two sides thereof individually, and an extension 414 is extendedly attached on the outer thread 413. The peripheral bulge 411 abuts against the inner sidewall of the upper housing 10, and the outer thread 413 is screwed with the tubular member 42 so that the extension 414 is received in the tubular member 42. An opening of a distal end of the loading bolt 412 is formed in the shape of a dented arcuation to propel the paintball A, and between the loading bolt 412 and the extension 414 is axially mounted the projectile channel 415. The tubular member 42 includes a first conduit portion 421 and the second conduit portion 422 between which an internal passage 423 is axially arranged. The first conduit portion 421 includes an inner thread 424 provided in the internal cutout thereof to screw with the outer thread 413 of the projectile member 41, and the first conduit portion 421 includes a plurality of bores 425 formed therearound and proximate to the inner thread 424, the second conduit portion 422 includes the semi-arcuate segment 4221 extending from the end portion thereof to be inserted into the receiving cavity 31 of the end cap 30, such that the tubular member 42 can be located in the upper housing 10 and the diameter of the first conduit portion 421 is greater than that of the second conduit portion 422. Moreover, between the end portion of the extension 414 and the connecting portion of the first and second conduit portions 421, 422 is an air valve 50 around which an outer peripheral flap 51 is affixed (as shown in FIG. 2A) for retracting or expanding based on the flowing direction of the pneumatic air, thus moving between first and second valve positions, wherein the first valve position is located at a distal end of the extension 414 of the projectile member 41, and the second valve position is located at a distal end of a hollow exterior of the first conduit portion 421.

A first chamber B is formed inside of the tubular member 42 and between the tubular member 42 and the end cap 30, and a second chamber C is formed between the loading device 40 and the upper housing 10, the first chamber B is in communication with the rear port 13, and the second chamber C is in communication with the front port 12. The first chamber B includes the aperture 32 of the end cap 30 and the space formed between the receiving cavity 31 and the internal passage 423, and the second chamber C includes the space formed between the projectile member 41 and the upper housing 10. By screwing the tubular member 42 and the projectile member 41 together and by inserting the tubular member 42 into the receiving cavity 31, a third chamber D is formed between the tubular member 42 and the upper housing 10 to communicate with the internal passage 423 through the bores 425.

Figure 3:
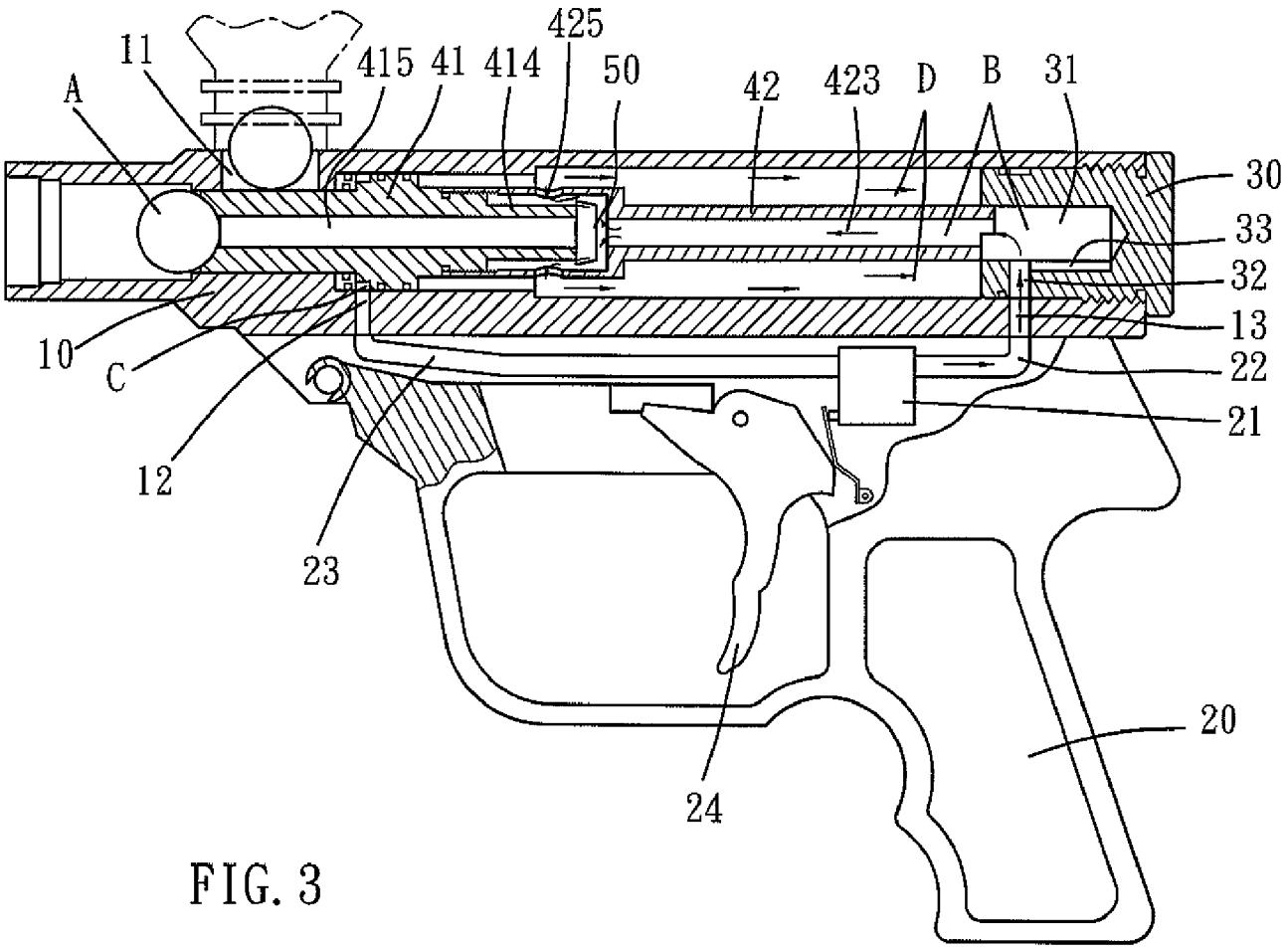
FIG. 3 is a cross sectional view illustrating a paintball being waiting for being propelled.

With reference to FIG. 3, as a user has not pulled a trigger 24, the pneumatic air released from the control valve 21 flows into the aperture 32 of the end cap 30 through the rear hose 22 and the rear port 13, and then flows into the second conduit portion 422 of the tubular member 42 through the receiving cavity 31. While the pneumatic air further flows into the first conduit portion 421 through the second conduit portion 422, its pressure pushes the air valve 50 toward the first valve position to close the cutout of the extension 414, and some pneumatic air flows into the chamber D through the bores 425 of the first conduit portion 421 to be stored. It is to be noted that as the third chamber D is completely full of the pneumatic air, the control valve 21 can stop releasing the pneumatic air.

Figure 4:
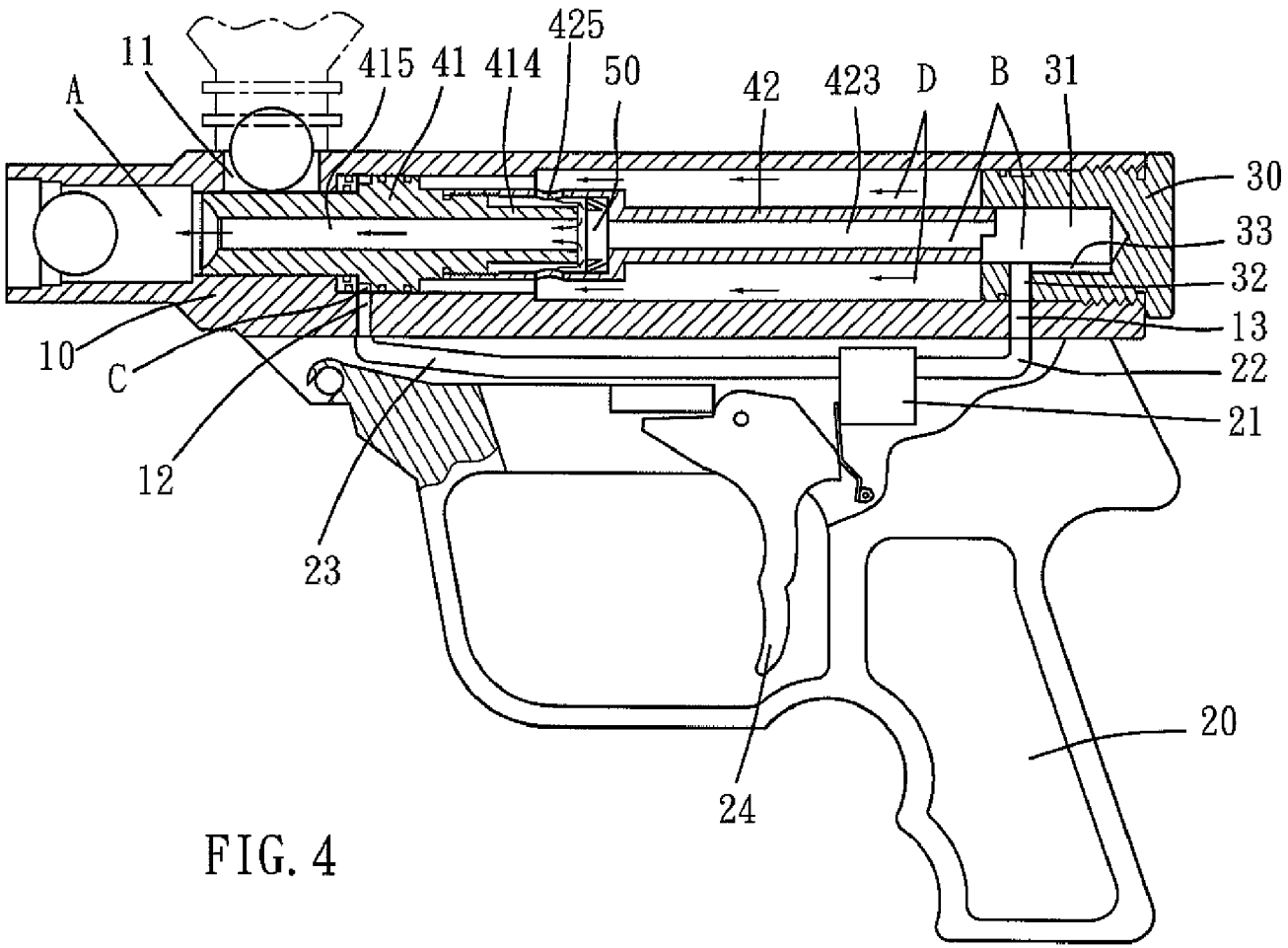
FIG. 4 is another cross sectional view illustrating the paintball being propelled.
Figure 5:
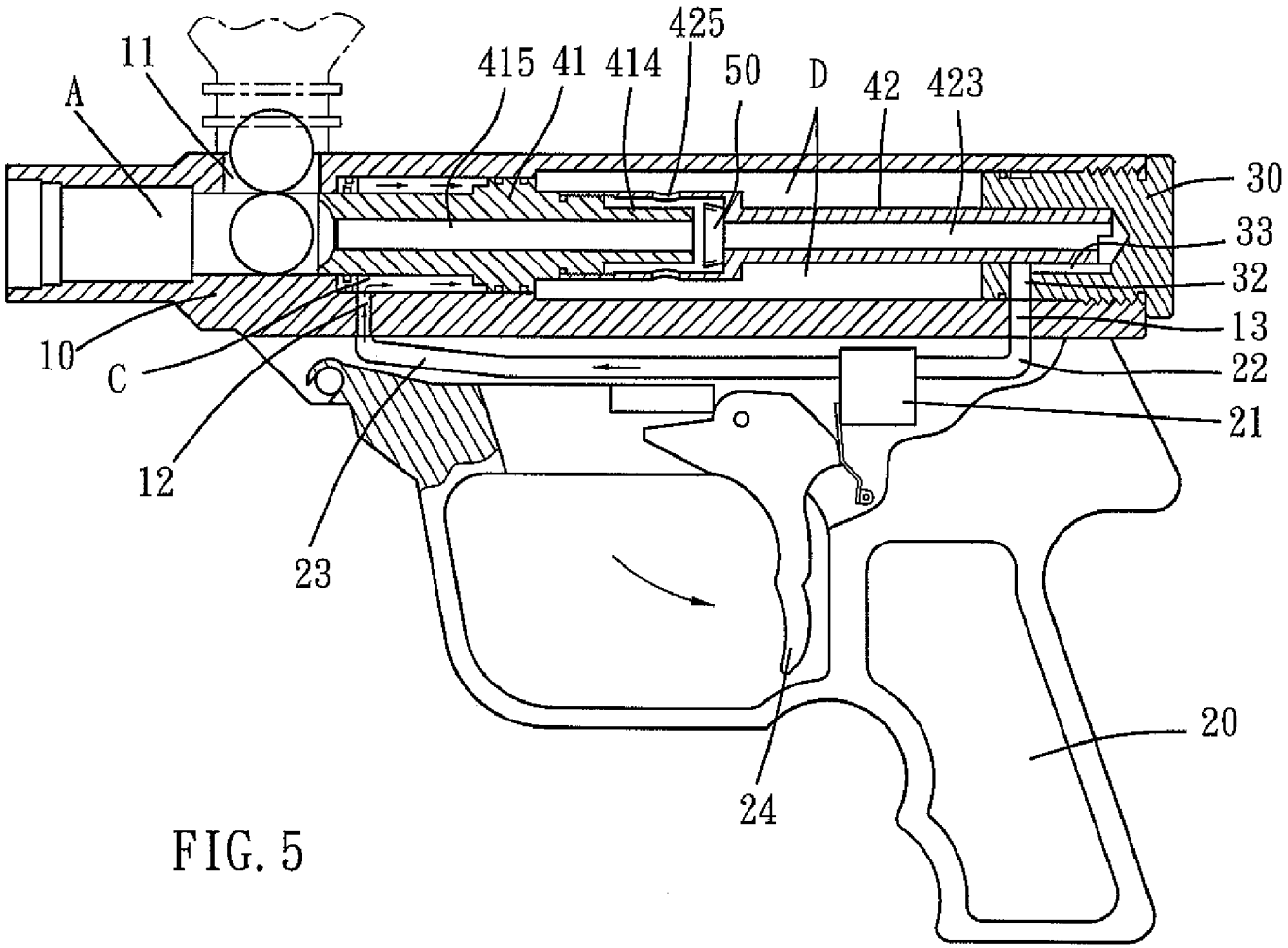
FIG. 5 is a cross sectional view illustrating another paintball being fed for waiting to be propelled.

Referring to FIG. 4, as the user pulls the trigger 24, the control valve 21 is urged to stop inputting the pneumatic air into the rear hose 22, meanwhile the pneumatic air in the third chamber D flows back to the first conduit portion 421, and the outer peripheral flap 51 of the air valve 50 is impacted to communicate the third chamber D with the projectile channel 415, and the air valve 50 is further pushed toward the second valve position, hence the flowing of the pneumatic air between the first and second conduit portions 421, 422 can be stopped. Simultaneously, the pneumatic air stored in the third chamber D urges the paintball A to move forward along the projectile channel 415, thus propelling the paintball A. As illustrated in FIG. 5, the control valve 21 inputs the pneumatic air to the front hose 23 for further flowing into the second chamber C through the front port 12, thereby expanding the second chamber C and pushing the loading device 40 toward the second loading device position. As the second conduit portion 422 inserts into the rear end of the receiving cavity 31, the control valve 21 stops inputting the pneumatic air to the front hose 23, and the rear hose 22 is opened to input the pneumatic air, such that the pneumatic air flows into the receiving cavity 31 through the cutout formed between the recess 33 of the end cap 30 and the semi-arcuate segment 4221 of the second conduit portion 422, hence the pneumatic air pushes the loading device 40 to move toward the first loading device position by means of the air valve 50 once more, indirectly pushing the paintball A to the predetermined propelling position, and then the feeding inlet 11 is closed and the pneumatic air starts to be stored in the third chamber D for providing the user to pull the trigger 24 again.

The invention is not limited to the above embodiment but various modifications thereof may be made. It will be understood by those skilled in the art that various changes in form and detail may be made without departing from the scope and spirit of the present invention.

What is claimed is:

1. A gas gun having a pressure driving device comprising a hollow upper housing including a feeding inlet provided on and passing through the top surface thereof, including a front port and a rear port disposed on and communicating with the bottom thereof respectively, and including an end cap fixed at an opening of a distal end thereof to tightly cover the opening of the distal end of said upper housing;

a hand grip mounted on and extending from the lower side of said upper housing and having a control valve arranged therein, said front and rear ports communicating with said control valve through a front hose and a rear hose individually, such that said control valve controls pneumatic air to flow into either said front port or said rear port;

wherein a loading device includes a projectile member and a tubular member, one end of said projectile member is provided to propel a paintball, and another end thereof is inserted into said tubular member, said projectile member includes a projectile channel axially mounted therein, and said tubular member includes a first conduit portion and a second conduit portion between which an internal passage is axially arranged, and said tubular member includes a plurality of bores formed therearound, one end of said tubular member is provided to receive said projectile member, and another end thereof is inserted into said end cap;

wherein said loading device is disposed in said upper housing so as to be pushed by the pneumatic air to move frontward and backward between first and second loading device positions, such that when said loading device is located at the first loading device position, said feeding inlet is closed, and when said loading device is located at the second loading device position, said feeding inlet is open;

wherein a first chamber is formed inside of said tubular member and between said tubular member and said end cap, and a second chamber is formed between said loading device and said upper housing, said first chamber is in communication with said rear port, and said second chamber is in communication with said front port, between said tubular member and said upper housing is formed a third chamber for communicating with said internal passage through said bores;

wherein between said projectile channel and said internal passage is an air valve, and said air valve is pushed by the pneumatic air to move frontward and backward between first and second valve positions, wherein the first valve position is located at a distal end of an extension of said projectile member, and the second valve position is located at a distal end of a hollow exterior of said first conduit portion, as said air valve is located at the first valve position, it closes said projectile channel so that the pneumatic air flows among said first chamber, said internal passage and said third chamber, and said loading device is pushed by the pneumatic air to move from the first loading device position to the second loading device position;

wherein as said third chamber is completely full of the pneumatic air, said control valve stops releasing the pneumatic air, meanwhile the pneumatic air in said third chamber flows back to impact said air valve to move toward said second valve position, opening said projectile channel and closing said internal passage, such that the pneumatic air flows through said projectile channel to propel said paintball outwardly;

wherein as the pneumatic air released from said control valve is inputted into said second chamber through said front hose, said loading device is pushed back to the second loading device position.

2. The gas gun having a pressure driving device as claimed in claim 1, wherein said control valve is controlled by pulling a trigger which is disposed at a front end of said hand grip.

3. The gas gun having a pressure driving device as claimed in claim 1, wherein around said air valve is affixed an outer peripheral flap for either retracting or expanding based on the flowing direction of the pneumatic air.

4. The gas gun having a pressure driving device as claimed in claim 1, wherein the diameter of said first conduit portion is greater than that of said second conduit portion.

5. The gas gun having a pressure driving device as claimed in claim 1, wherein said receiving cavity is secured in said end cap in a radial direction to receive said second conduit portion, and an aperture is affixed in said end cap in an axial direction to said receiving cavity and said rear port with each other.

6. The gas gun having a pressure driving device as claimed in claim 1, wherein said first chamber includes said aperture of said end cap and the space formed between said receiving cavity and said internal passage, and said second chamber includes the space formed between said projectile member and said upper housing.

* * * * *